United States Patent [19]

Suzuki et al.

[11] 4,185,179

[45] Jan. 22, 1980

[54] KEY-SWITCH DEVICE

[75] Inventors: Takao Suzuki, Oume; Yasuo Miyamae, Minano, both of Japan

[73] Assignees: Japan Aviation Electronics Industry, Ltd.; Sampo Lock Co., Ltd., both of Tokyo, Japan

[21] Appl. No.: 874,862

[22] Filed: Feb. 2, 1978

[30] Foreign Application Priority Data

Feb. 5, 1977 [JP] Japan ..... 52-12023

[51] Int. Cl.[2] ..... H01H 27/06

[52] U.S. Cl. ..... 200/44

[58] Field of Search ..... 200/44

[56] References Cited

U.S. PATENT DOCUMENTS 4,051,349 9/1977 Englund ..... 200/44

FOREIGN PATENT DOCUMENTS 2402123 11/1974 Fed. Rep. of Germany ..... 200/44

957088 5/1964 United Kingdom ..... 200/44

*Primary Examiner*—Steven L. Stephan

*Attorney, Agent, or Firm*—Hammond & Littell

[57] ABSTRACT

A key-switch device has mechanisms for locking an actuating member and devices for switching an electric circuit printed on a board. A specific key for releasing the lock of the actuating member is inserted into a key way in the actuating member, and the switching action of the circuit is effected by means of the key. A notch may be provided with the key for selectively effecting the switching action.

3 Claims, 7 Drawing Figures

KEY-SWITCH DEVICE

BACKGROUND OF THE INVENTION

This invention relates to a key-switch device and more particularly to an electric switch device for effecting the switching action of an electronic or electric circuit by means of a specific key.

In a conventional key-switch device, a plug or inner cylinder is rotatably mounted in a casing, the rotation of the inner cylinder with respect to the casing is prevented by means of pin tumblers cooperating with springs. When the correct key is inserted into a groove in the cylinder, the tops of the pin tumblers flush with the outer wall surface of the cylinder, and then the cylinder is free to rotate with the turn of the key for operating electric switch mechanisms.

OBJECTS OF THE INVENTION

It is an object of the invention to provide a key-switch device which is capable of effecting the switching of electric or electronic circuits by displacing a key with respect to its longitudinal axis at a predetermined angle without turning.

It is another object of the present invention to provide a key-switch device which enables to switch the electric circuit by means of a set of specific keys.

It is another object of the present invention to provide a key-switch device which is capable of switching desired electric or electronic circuits by the selection of the keys.

OUTLINE OF THE DRAWINGS

The above and other objects and features of the invention will appear more fully hereinafter from a consideration of the following description taken in connection with the accompanying drawings, wherein.

DESCRIPTION OF THE INVENTION

Figure 1:
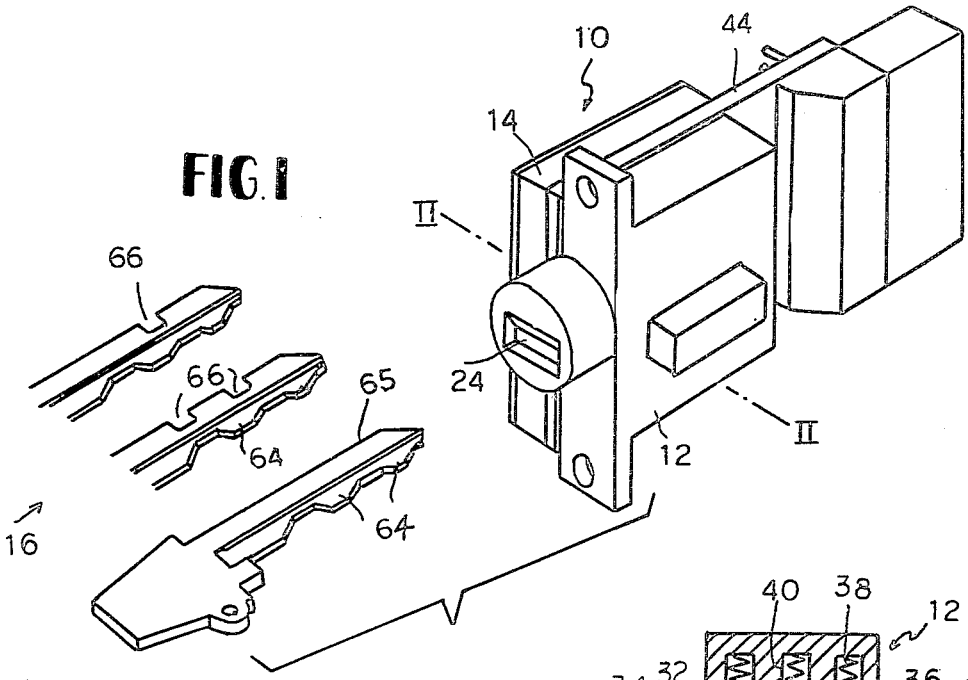
FIG. 1 is a perspective view of a key-switch device according to the present invention.
Figure 2:
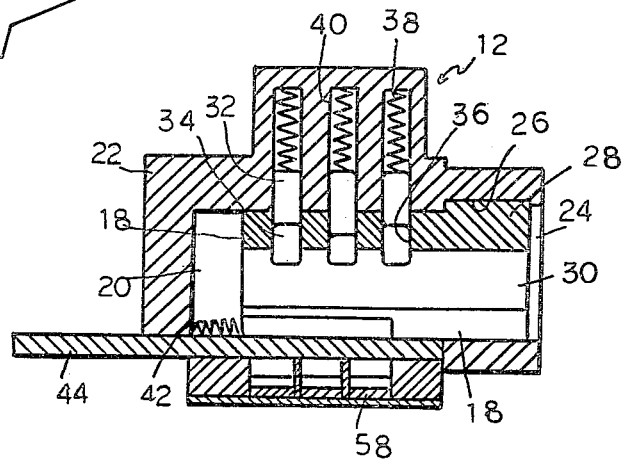
FIG. 2 is a sectional view taken substantially along lines II—II of FIG. 1.

Referring now in more detail to the drawing, there is illustrated a preferred embodiment of a key-switch device 10 according to the present invention, which comprises a switch section 14 which may be connected to a circuit of electric or electronic apparatus and a specific key 16.

The lock assembly 12 is comprised by an actuating member 18 and a casing 22 having a recess 20 in which the actuating member is mounted. In a front wall of the casing 22 there is provided with a slot opening 24 which is adapted to insert the key 16, the opening being communicated to the recess 20. The portion 26 of the recess adjacent to the slot 24 is formed to mount the actuating member 18.

The actuating member 18 has a cylindrical head 28 which is received in the portion 26 so as to move the actuating member 18 about the head 28 at a predetermined angle.

Figure 3:
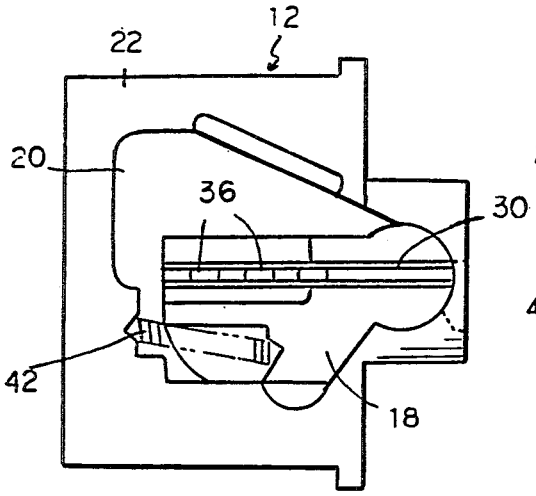
FIG. 3 is a side elevation of the key-switch device, a switch section being removed.

A key way 30 is extended through a length of the actuating member 18 from the end of the head 28 so as to register it with the opening 24 in the casing 22 when the actuating member 18 has been positioned in the recess 20 in the casing for inserting the key 16, In the side wall of the key way 30 in the actuating member 18, there are holes 36 which respectively receive a number of pin tumblers comprising an upper and lower segment of different lengths. In the side wall of the casing 22, on the other hand, there are holes 40 whsich respectively receive a spring 38 cooperating with the pin tumblers 32 and 34. The movement of the actuating member 18 with respect to the casing 22 is prevented by means of these pin tumblers 32 and 34 and springs 38. When the proper key 16 is inserted into the key way 30 in the actuating member 18, the lower segments 34 of the pin tumblers are raised by exactly the correct amount to bring their tops flush with the outer surface of the actuating member 18 in accordance with the shape of the wards 64 of the key 16. As the two segments of each pin tumbler are separate, i.e., not interconnected, the actuating member 18 is then free to move from a position shown in FIG. 3 to a position shown in FIG. 4, when the outer end of the key 16 inserted into the key way is pushed down.

Figure 4:
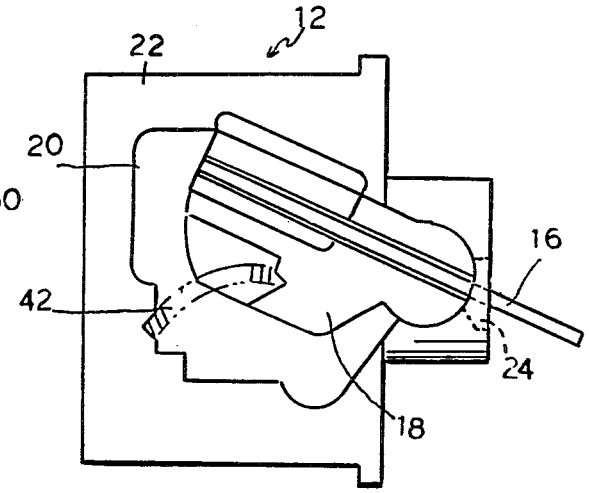
FIG. 4 is a view similar to FIG. 3 illustrating the movement of an actuating member.

In order to hold the actuating member 18 with respect to the casing 22 in the position shown in FIG. 4, a coil spring 42 is provided between the casing 22 and the actuating member 18. The coil spring 42 is compressed during the movement of the actuating member 18 and is extended to accurately hold the actuating member 18 at the final stop position shown in FIG. 4.

Figure 5:
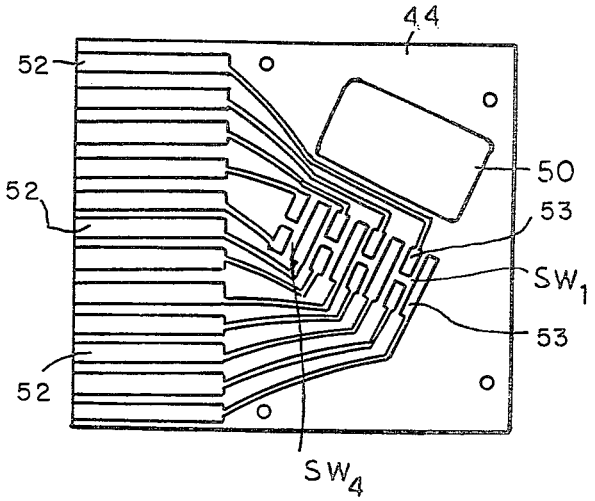
FIG. 5 is a plan view of a printed circuit board of the switch section.
Figure 6:
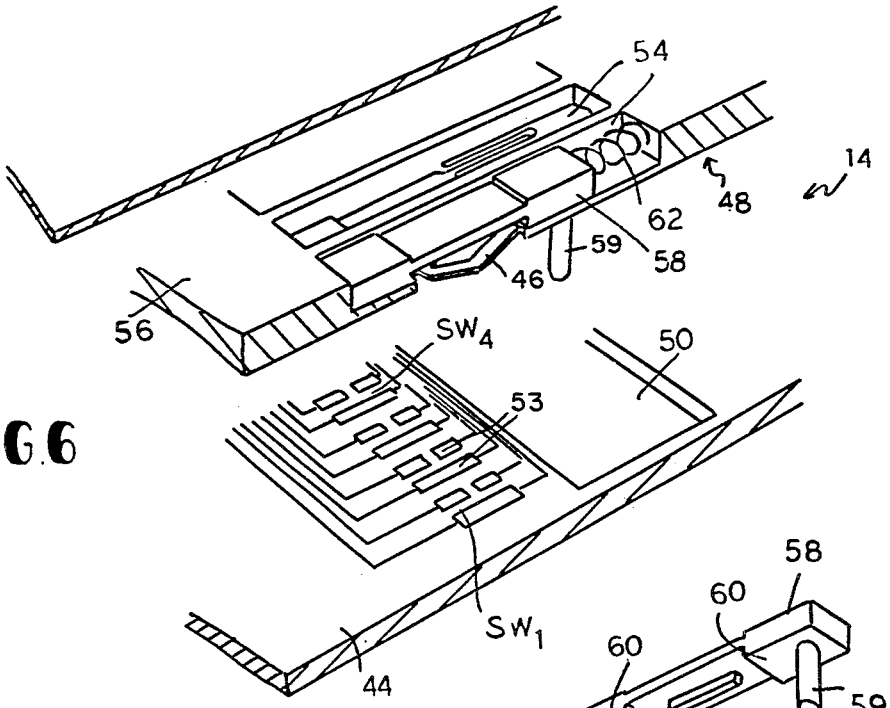
FIG. 6 is an exploded view of the switching section according to the present invention.

A switch section 14 is composed of a board 44 of dielectrical material, switch members 46 and a guide means 48. The board may be attatched to the casing 22 so as to cover the recess 20 in the casing and has an opening 50 which communicates with the recess 20. Conductors containing terminals 52 which may be connected to the circuit of electric or electronic apparatus (not shown) and contacts 53 forming a set of switch portions SW are printed on the surface of the board 44. In FIGS. 5 and 6, four sets of switch portions $SW_{1-4}$ are illustrated.

The switch member 46 cooperating with the contacts 53 for switching the circuit relating to each of the terminals are arranged in the guide assembly 48 which consists of a plate 56 of dielectric material having slits 54 in the position corresponding to a set of switches. A holder 58 on which the switch member 46 is mounted may be slidably mounted in the slit 54. As shown in FIG. 6, the holder 58 is of an L-shaped member having a stem 59 which extends into the recess in the casing passing through the slit 54 and the opening 50 in the printed circuit board 44 so as to engage with the edge of the key 16 inserted into the key way 30 in the actuating member 18. The switch member 46 may be mounted on the holder 58 in the side facing to the contact of the printed circuit board 44.

Figure 7:
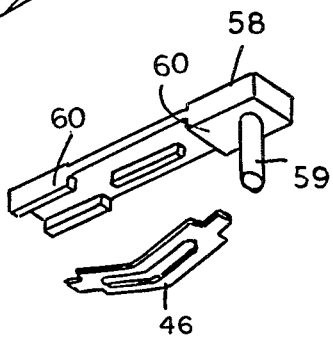
FIG. 7 is a perspective view of a switch member and a holding device according to the invention.

As shown in FIGS. 6 and 7, the switch member 46 is made of a resilient metal in the form of "V" shape, and supported between the projections 60 and 60 formed at the opposite sides of the holder 58. The holder 58 is biased by a spring 62 in the direction to contact the switch member 46 with the contacts of one of the circuits. When the key 16 is inserted into the key way 30 in the actuating member 18, the stem 59 of the holder 58 engages with the side edge of the key 16. By pushing down the key 16, the holder 58 is moved within the slit 54 in the holder 58 against the force of the spring 62, thereby the switch member 46 releases the connection of one of the circuits to close the other circuit, and the switching action may be effected.

Along one edge of the key 16, there are provided with cuts or wards 64 which are shaped so as to cooperate with the pin tumblers to unlock the actuating member 18 relative to the casing 22, and the other edge 65 of the key is capable of engaging with the stem 59 of the holder 58 as stated above.

In the edge portion 65 of the key 16, a notch or notches 66 may be provided for passing through the stem 59 freely without contacting it with the key.

Accordingly, if a set of keys having the wards 64 for driving the pin tumbles 32 and 34 while the notch 66 is selectively provided in accordance with the position of the contacts are prepared, it is possible to switch the circuits selectively.

While a preferred embodiment of the invention has been described, it is to be understood that various changes and modifications may be made in the invention without departing from the spirit and scope of the following claims.

What we claim is:

1. In a key-switch device comprising in combination a switch section and a set of associated keys, said switch section includes a casing having a cavity therein and an opening adapted to insert any of a set of associated keys; an actuating member having a head pivotably supported in said casing and a guide groove adapted to insert any of a set of associated keys; means for locking said actuating member to said casing; a printed circuit board having a plurality of terminals with associated contacts; a plurality of contact members associated to said contacts forming a holding means; and guide means having a plurality of grooves for sliding said holding means therein, and said set of associated keys have portions for releasing said locking means from said casing and for actuating selected holding means.

2. A key-switch device claimed in claim 1 in which said locking means comprises a number of pin tumblers of different lengths and comprising an upper and lower segment and spring members.

3. A key-switch device claimed in claim 1 in which at least one of the set of associated keys has a notched configuration comprising one or more notches such that said holding means is selectively actuated.

* * * * *